United States Patent [19]

Bloxham

[11] 4,280,457

[45] Jul. 28, 1981

[54] SYSTEM FOR MONITORING AND IMPROVING MOTOR VEHICLE OPERATING EFFICIENCY

[76] Inventor: Steven R. Bloxham, P.O. Box 2821, Scottsdale, Ariz. 85252

[21] Appl. No.: 29,638

[22] Filed: Apr. 13, 1979

Related U.S. Application Data

[63] Continuation-in-part of Ser. No. 889,194, Mar. 23, 1978, abandoned.

[51] Int. Cl.[3] ..... F02B 77/00; F25B 27/00

[52] U.S. Cl. ..... 123/198 R; 123/198 D; 62/323.1; 307/10 R

[58] Field of Search ..... 123/198 R, 198 D; 62/323 R, 323 C, 323 B, 213, 133; 307/10 R; 340/52 R

[56] References Cited

U.S. PATENT DOCUMENTS

| | | | |
|---|---|---|---|
| 2,601,757 | 7/1952 | Horton | 123/198 R |
| 3,606,764 | 9/1971 | Yokouchi et al. | 123/198 R |
| 3,678,912 | 7/1972 | Hensler | 123/198 D |
| 3,686,891 | 8/1972 | Wills | 62/323 C |
| 3,918,543 | 11/1975 | Halem | 62/323 C |
| 4,135,368 | 1/1979 | Mohr et al. | 62/323 |
| 4,144,862 | 3/1979 | Estkowski | 123/198 D |
| 4,206,613 | 6/1980 | Shockley | 62/133 |

*Primary Examiner*—P. S. Lall

*Attorney, Agent, or Firm*—Joseph H. Roediger

[57] ABSTRACT

A system responsive to engine manifold pressure for monitoring engine operating efficiency and reducing engine load during periods of low operating efficiency is disclosed. The system includes a switch which actuates a first relay when manifold vacuum pressure drops below a threshold level. In this condition, the first relay activates a time delay relay in the control circuit of the air conditioning compressor to remove this load from the engine after a first interval and maintain it in the off condition for a second interval.

7 Claims, 2 Drawing Figures

SYSTEM FOR MONITORING AND IMPROVING MOTOR VEHICLE OPERATING EFFICIENCY

BACKGROUND OF THE INVENTION

This is a continuation-in-part of copending application Ser. No. 889,194, filed Mar. 23, 1978, now abandoned.

This invention relates to a system for monitoring the operating efficiency of an internal combustion engine and reducing the load on the engine during periods of reduced operating efficiency.

The combination of higher fuel costs for the operation of motor vehicle engines and the modifications in engine design for environmental control which result in increased fuel consumption have generated interest in improving motor vehicle operating efficiency and thus reducing operating cost. In the case of fleet owners of vehicles, the increased fuel costs and reduction in mileage per fuel gallon has produced a marked increase in operating cost and a concomitant decrease in profitability. As a result, a definite need for systems which can monitor the operation of the vehicle and improve the efficiency of operation has been generated.

A system for indicating a reduction in engine manifold vacuum pressure by means of a light on the vehicle dashboard has been incorporated in some original equipment vehicles from manufacturers. This passive system requires that the operator note the indication of system inefficiency and take positive action to improve it. In the case of fleet owners having large numbers of vehicles and hired drivers, signals from this type of passive system are often not observed. In addition, it is difficult for the owner-employer to readily identify those operators taking positive action to improve the vehicle operating efficiency.

Accordingly, the present invention is directed to a system which reduces the loading of the vehicle engine when the manifold vacuum pressure is less than a predetermined threshold level without requiring action by the operator to effect this shedding of the load. In addition, the invention incorporates monitoring apparatus in the system, to provide indications of the operator's inability to maintain a relatively high engine operating efficiency as indicated by the number of times the vacuum pressure decreases below the threshold level. Also the invention provides an indication of the time that the vehicle is operated in this less efficient condition. The information is available to the vehicle owner at the end of the period of operation and thus enables him to determine the habitually inefficient employee-operator of his vehicles.

SUMMARY OF THE INVENTION

The present invention for improving motor vehicle operating efficiency and monitoring the occurrence of intervals of relatively inefficient operation includes an electrical system connected to the electrical circuit of the motor vehicle and which is responsive to one or more of the operating conditions of the motor vehicle, such as the pressure level within the manifold of the engine.

The system includes a first relay means having a first control element and a first switch element having first and second states. The first switch element is responsive to the first control element and changes state accordingly. Also included is a switch responsive to a vehicle operating condition and having first and second states.

This switch changes state in response to variations in the operation condition being monitored; for example, changes in the manifold pressure about a threshold level, and is coupled between the vehicle electrical circuit and the first control element. The lowering of the engine operating condition below the threshold level causes the first control element to be activated and changes the state of the first switch element from a normally closed state to an open circuit state.

A second relay means having a second control element and a second switch element having first and second states is provided. The second switch element is responsive to the second control element and changes state accordingly. The second control element is coupled between the vehicle electrical circuit and the first switch element. In operation the second control element is deactivated by the opening of the first switch in response to a change in vehicle operating condition below the threshold level.

The second switch is coupled into the control circuit of at least one vehicle accessory, generally the air conditioning compressor control circuit. This second switch is in a normally open circuit state. The energization of the second control element causes the second switch element to enter the closed circuit state. Since the first switch element of the first relay means is normally closed, the second control element is typically energized during efficient vehicle operation and the second switch is closed thereby not altering the vehicle accessory operation. When the second switch is in its open circuit state, the controlled accessory load is not coupled to the vehicle engine.

The second relay means preferably include time delay means which delay the opening of the second switch element for a first interval after the opening of the first switch element. Thus, the controlled accessory is not shed from the vehicle engine load unless the vehicle operating condition stays below the threshold level for the duration of the first interval. The time delay means also maintains the second switch element in the open circuit state for a second predetermined interval after the closing of the first switch element. The controlled accessory is then cutoff for at least as long as the second interval. The time delay means essentially eliminates the transient effects associated with urban driving patterns.

The monitoring of vehicle operation is provided by a third switch element having first and second states and responsive to the activation of the first control element of the first relay means. Timing and counting means are coupled between the third switch element and the ignition circuit so that their operation is initiated by a drop in the vehicle operating condition below the threshold level.

The present invention provides increased operating efficiency by the load shedding of selected vehicle accessories in response to changes in operating conditions and provides the vehicle owner with the number of occurrences and the total operating time under the low operating conditions.

Further features and advantages of the invention will become more readily apparent from the following detailed description of a specific embodiment of the invention taken in conjunction with the accompanying drawings.

DESCRIPTION OF THE PREFERRED EMBODIMENTS

Figure 1:
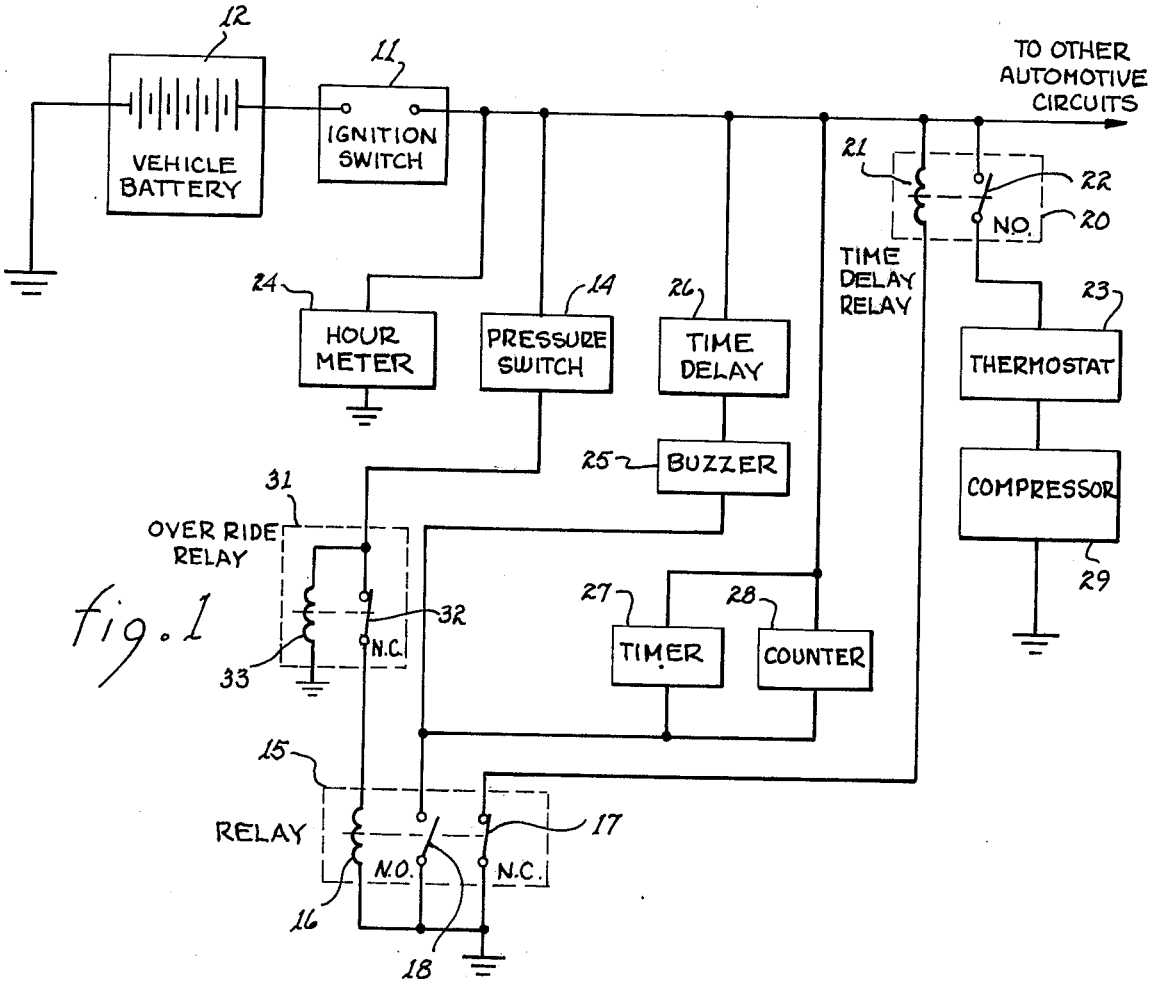
FIG. 1. is a block schematic diagram of one embodiment of the invention.

Referring now to FIG. 1, the invention is shown in a block schematic form. The conventional automotive key-activated ignition switch 11 is shown electrically connected to the positive terminal of the motor vehicle battery 12. The negative terminal is coupled to a reference potential, normally the vehicle chassis.

The ignition switch is electrically connected to a pressure-responsive electrical switch 14. Switch 14 has open and closed states and remains in the normally open condition as long as the vacuum pressure in the region being monitored is above a threshold level. In the present invention, the pressure being monitored is that of any vacuum system directly responsive to the engine intake manifold pressure. While the pressure-responsive switch may be inserted directly into the intake manifold, it has been found advantageous to monitor the vacuum pressure in a spark advance vacuum system that is directly responsive to the intake manifold pressure. The term vacuum pressure as utilized herein is taken to mean negative pressure.

In tested embodiments, the pressure responsive switch is selected to change state at a threshold vacuum pressure of approximately six to eight inches of mercury. Since vehicle operating elevations differ significantly, the threshold level of the vacuum pressure switch can be selected to be 85 to 90 percent of the manifold vacuum pressure of a vehicle operating at 60 miles per hour with substantially zero acceleration.

In certain vehicles, the spark advance vacuum system is not directly responsive to manifold pressure due to the incorporation of a delay function in the design of the vehicle. In vehicles of that type, the pressure responsive switch is located so as to directly monitor manifold pressure, preferably intake manifold pressure due to the lower operating temperatures therein when contrasted with the exhaust manifold system which not only has a higher operating temperature but is more likely to contain pressure leaks.

The embodiment shown in FIG. 1 utilizes the monitoring of vacuum pressure to determine the engine operating conditions and to establish the threshold level for operation of the invention. Due to the availability of vacuum switches to the system installer and the reliability of vacuum pressure monitoring devices, this embodiment enables presently operating vehicles to be retrofitted with the invention for a relatively low cost. However, other engine operating monitoring devices can be employed if desired. For example, the rotation of the drive shaft or an axel could be monitored by either direct drive linkage or by optical monitoring. These types of monitoring could be utilized to activate subsequent system components based on rates of acceleration or merely high speeds, if desired. In addition, the fuel supply system can be monitored by a flowmeter and a threshold established indicative of a particular operating condition. Embodiments of these types utilizing different engine operating condition monitors are difficult and relatively expensive to install in presently operating vehicles and better suited to be incorporated by the manufacturer in new vehicles.

The pressure switch 14 is electrically connected to the control element 16 of first relay 15. When the ignition switch is turned on and the vacuum pressure in the intake manifold is below the threshold level, the pressure switch is actuated and a voltage is applied across the control element 16. First relay 15 includes switches 17 and 18 each having first and second states and each of which is responsive to the application of the voltage across control element 16. As shown in FIG. 1, first switch 17 is in the normally closed state and opens when the vacuum pressure in the manifold drops below the threshold level. Switch 18 is shown in its normally open state and closes when control element 16 is energized.

Switch 17 is coupled via control element 21 of time delay relay 20 to the ignition circuit. Thus, when switch 17 is closed, a voltage is applied across control element 21. Also included in relay 20 is switch element 22 having a normally open state. Switch 22 is utilized to electrically couple the thermostatic control 23 for the vehicle air conditioning compressor 29 to the ignition switch. Switch 22 is shown in the normally open state. When closed, the combination of the thermostatic control 23 and the compressor 29 operate in their normal operating mode. This operation is interrupted by the opening of switch 17 which results in the removal of the voltage across control element 21 and causes switch 22 to return to the open circuit state. Consequently, the air conditioning circuit is disabled at this point in time and the compressor load is no longer present for the motor vehicle engine.

Switch 18 of first relay 15 is coupled to the ignition switch via the series combination of time delay 26 and indicating device 25. When switch 18 is closed in response to a low vacuum pressure state sensed by switch 14, the indicating device 25 shown as a buzzer in FIG. 1 is activated to identify the low operating efficiency condition to the operator. In addition, the buzzer points out to the operator that maintenance of the low operating efficiency condition will result in one or more controlled accessories being removed as vehicle engine loads. Time delay 26 is characterized by a normally closed state in the absence of a voltage applied thereacross. When switch 18 is closed, the voltage is applied across the combination of indicating device 25 and time delay 26. The time delay 26 remains in the closed state for an interval of time and then opens the circuit to disable the buzzer to prevent the continuous signalling to the operator. If desired, a manual switch may be connected in electrical series with buzzer 25 to permit the operator to disable the buzzer.

Also, switch 18 is coupled to the ignition switch via the parallel combination of timer 27 and counter 28 so that the closing of switch 18 activates these two components. Timer 27 is activated by the closure of switch 18 and is an elapsed time indicator which at the end of a long period of vehicle operation shows the amount of time during which the vehicle was operated in the low efficiency condition. Counter 28 is activated at the same time and records the number of occurrences of the low operating efficiency condition.

Also included in the preferred embodiment is hourmeter 24 connected directly to the ignition circuit. Consequently, this meter records the total elapsed time during which the vehicle is operated. The relays 15 and 20 provide the load shedding feature of the invention which enhances operating efficiency while the timer and counter provide the fleet owner with the information necessary to determine the nature of the operator's driving habits. If desired, hourmeter 24 provides the total elapsed time of operation. The feedback of information to the operator is provided by relay 15 and the combination of buzzer 25 and time delay 26.

Since the vehicle is expected to operate under a variety of traffic conditions, it has been found advantageous to incorporate time delays in second relay 20. The initial delay makes the switch 22 achieve its open condition a first predetermined interval after the voltage is removed from across control element 21 due to the opening of switch 17. Also, a second delay is provided to maintain the switch 22 in the open position for a second interval after switch 17 is closed to again apply the voltage across element 21. The use of the delay intervals presents the repeated on-off cycling of the controlled accessories which would occur due to the stop-start followed by rapid acceleration cycles characteristic of many urban traffic patterns. In addition, the combination of the normally open state of switch 22, the normally closed state of switch 17 and the time delay of relay 21 result in the air conditioning and/or controlled loads not being coupled to the engine when it is initially started. The controlled loads remain decoupled from the engine after closure of the ignition switch for the duration of the second interval. The second interval is longer than the typical time utilized to engage and disengage the starter motor, for example five seconds, and is therefore not determined by the engine operating efficiency. While the engine may achieve an efficient operating condition shortly after disengagement of the starter motor, the lengthened second delay interval has been found to reduce the potential for stalling when engine operation is initiated.

The foregoing detailed description of the embodiment of FIG. 1 refers to the use of relays and time delay relays which are discrete or individual electrical components. The term relay as used herein is intended to mean an electrically controlled device having at least two states which correspond to the open circuiting and the conducting states of a conduction path in an electric circuit. Thus, it is intended to include solid state devices, whether a discrete component or an integrated part of a multi-element semiconductor device. In the case of a time delay relay, the actuatable switch element and the time delay element may be either integrated into one component or may be two discrete elements coupled together to operate in the intended manner as described below in connection with the waveforms.

Figure 2:
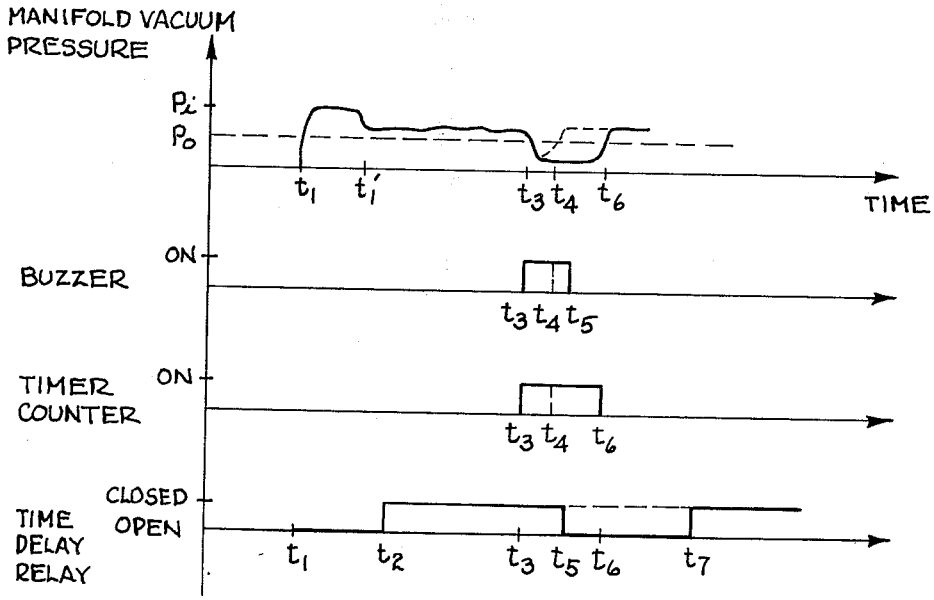
FIG. 2 is a series of timing diagrams illustrative of the operation of the embodiment shown in FIG. 1.

The operation of the system is shown in the waveforms of FIG. 2 wherein the manifold vacuum pressure is plotted as a function of time. At time $t_1$, the ignition switch is turned on and the engine is started. The vacuum pressure increases to P (i.e. absolute pressure drops) in the intake manifold. After starting at time $t_1$, the engine is idling and the vacuum pressure remains above the threshold pressure $P_0$ until time $t_3$ when the driver elects to accelerate the vehicle rapidly.

Although the ignition switch 11 was closed at time $t_1$ and the manifold vacuum pressure increased to a level above the threshold, the time delay relay provides an open circuit condition in the controlled accessory circuit until time $t_2$. This delay insures that the accessories are not coupled to the engine during the initial start period when inefficient operation is likely to be encountered. As shown by the solid line of the vacuum pressure, the driver begins to accelerate at time $t_3$ and maintains this acceleration rate until time $t_6$. This situation is typical of a passing situation or high speed on an incline. At time $t_6$, the acceleration rate is decreased and the manifold vacuum pressure is again above the threshold level $P_0$ signifying that the vehicle is again operating in a relatively fuel-efficient manner.

At time $t_3$ when the driver has elected to rapidly accelerate, switch 18 closes and the buzzer 25, timer 27 and counter 28 operate. The buzzer is non-operative at time $t_5$ due to the time delay circuit 26 which typically is set for a 0.5 second operating interval. The timer and counter remain activated until time $t_6$ when the vacuum pressure rises above the threshold level $P_0$.

The opening of switch 17 at time $t_3$ results in the opening of switch 22 after a delay interval of 1.0 to 1.5 second at time $t_5$. The switch 22 remains open after time $t_6$ due to the second delay of about four seconds and closes at time $t_7$. Thus, the air conditioning compressor 29 is removed as an engine operating load for the $t_7-t_5$ interval thereby improving operating efficiency. The $t_7-t_6$ interval is equal to the $t_2-t_1$ interval provided at the initial starting of the vehicle engine.

The broken lines of FIG. 2 illustrate the operation of the invention during periods of short rapid acceleration similar to the operation resulting from the passing of another motor vehicle. At time $t_3$ the vehicle vacuum pressure drops below the threshold level $P_0$ and returns at time $t_4$. The buzzer, timer and counter are all activated and then de-activated at time $t_4$. The time delay relay and switch 22 remain in the closed position since the $t_4-t_3$ interval is less than the duration of the first delay interval provided by relay 20.

In embodiments of the invention installed in vehicles wherein extended periods of inefficient operation are likely to be encountered, it has been found desirable to utilize the prior-discussed embodiments with an override relay 31 provided as shown in FIG. 1. One example of the type of driving condition which gives rise to a need for the incorporation of relay 31 is the large change in elevation experienced during driving through the Rocky Mountain region of the United States. In situations of this type, the operator does not wish to have the controlled accessories inoperable for this extended period and the override relay is included to set a maximum time for the energization of control element 16 and the resulting deenergization of control element 21.

During operation, switch 32 of relay 31 is normally closed and the embodiment of FIG. 1 operates as previously described with current flowing to relay 15 upon the activation of pressure switch 14. In addition, current flows through control element 33 and after a predetermined interval, typically 20 to 40 seconds, the control element 33 heats to a level wherein switch 32 opens, thus halting the flow of current to relay 15 and permitting switch 17 to close. As a result, control element 21 is energized and switch 22 closes to permit the controlled accessories to resume operation. Switch 32 stays open until pressure switch 14 reopens and current no longer flows through control element 33. In practice, a one second delay in the closing of switch 32 is provided. When the switch is again closed, the sequence previously described can be repeated when inefficient operation is next encountered.

In embodiments of the invention as shown in FIG. 1 wherein the buzzer notifies the vehicle operator of inefficient operating conditions which embodiments have been tested for over one thousand miles in a Volkswagon Rabbit and a Pontiac Bonneville, the number of rapid accelerations was decreased by four to five times due to operator recognition of inefficient operating conditions. The percentage of total operating time spent under heavy acceleration with an intake manifold vacuum pressure of less than eight inches of mercury was reduced from 8.7% to 0.9% in the case of the Volkswagon and from 9% to 1.2% for the Pontiac. The fuel consumption as measured by mile per gallon calculations improved in the Volkswagon from 27.2 to 32.1 miles per gallon and in the Pontiac from 12.0 to 14.3. In embodiments of the invention wherein the indicating device 25 is not utilized to notify the driver, the shedding of the controlled load in response to the activation of the relays has been found to provide a four to six percent increase in fuel economy during extended periods of vehicle operation.

The invention does not directly control the engine so that full power and acceleration are available to the operator at all times during operation if he requires them. Thus, the present invention does not alter the safety characteristics of the vehicle upon which it is fitted. The embodiment shown in FIG. 1 and the test data therefor refer only to the shedding of the air conditioner compressor load during the periods of inefficient operation. Other automobile accessories, for example the alternator, may be so controlled by providing either additional switches for the time delay relay and connecting this to the field armature winding or utilizing switch 22 for more than one accessory.

In the embodiment tested and operated as described herein, the pressure switch 14 utilized was a vacuum switch made by John W. Hobbs. Co., Springfield, Ill., with a threshold within the range of 6.5 to 7 inches of mercury, the first relay 15 was a Potter & Broomfield 12 v DPDT relay, the delay relay was a 12 volt normally open two second delay relay made by Amperite and the override relay 31 was a 12 volt normally closed 30 second delay made by Amperite. The delay interval for the override relay is normally selected to be shorter than the time interval required for the coils in the air conditioning unit to rise significantly in temperature. The fan in the vehicle continues to circulate air and it is found to improve the vehicle comfort level to have the override switch take effect prior to any significant temperature change in the vehicle. The particular delay interval is determined in part by the operating climate and the construction of the vehicle.

While the above description has referred to a specific embodiment of the invention, it will be recognized that many variations and modifications may be made therein without departing from the scope of the invention.

What is claimed is:

1. Apparatus for improving motor vehicle fuel efficiency by reducing the accessory load on the engine during periods of reduced operating efficiency, said apparatus, comprising:

(a) means for monitoring engine operating conditions and providing an output signal indicative of engine operating efficiency below a threshold level;

(b) time delay means responsive to the output signal of said monitoring means, said time delay means having first and second states and first and second pre-determined delay intervals, said time delay means being activated to the second state by the application of said output signal to the time delay means for at least as long as said first delay interval, said second delay interval occurring upon the terminating of said output signal whereby the time delay means remains in the second state for at least as long as the second interval;

(c) means for coupling the time delay means to the accessory being controlled, said accessory being disabled from operation when said time delay means is in the second state; and (d) override means coupled to the time delay means for limiting the duration of the disabling of the accessory to a third predetermined delay interval.

2. Apparatus in accordance with claim 1 wherein said time delay means includes a time delay relay having first and second states, said time delay relay being responsive to the output signal of said monitoring means.

3. Apparatus in accordance with claim 1 wherein said override means includes a time delay element which is responsive to the output signal of said monitoring means and has first and second states, said time delay element entering the second state after receipt of said output signal for the third interval and remaining in said second state at least until cessation of the output signal from said monitoring means.

4. Apparatus in accordance with claim 1 wherein said means for monitoring engine operating efficiency comprises pressure-responsive means for monitoring engine manifold pressure and providing an output signal indicative of engine operating efficiency below a threshold level.

5. Apparatus for improving motor vehicle operating efficiency by controlling the operation of vehicle accessories wherein said apparatus is connected to the vehicle electrical circuit and responsive to engine manifold pressure, said apparatus comprising:

(a) switch means having first and second states and responsive to changes in engine manifold pressure, said switch means being in the first state when the manifold vacuum pressure is less than a threshold level;

(b) time delay relay means having a first control element coupled to said switch means and the vehicle electrical circuit and a first switch element coupled to the accessory being controlled, said first switch element having a delayed response to the activation and deactivation of said first control element, said first control element being activated when the switch means enters the first state whereby the first switch element responds to disable the accessory;

(c) override delay means responsive to a change in state by the switch means to the first state for overriding the disabling of the accessory by the first switch element after a predetermined interval whereby said accessory resumes operation independently of the state of said switch means.

6. Apparatus in accordance with claim 5 wherein said time delay relay means comprises first and second relays, each having a switch element and a control element, the first relay control element being coupled to the switch means, the second relay switch element being coupled to the accessory being controlled, the first relay switch element being coupled to the second relay control element, one of said first and second relays having a delay therein.

7. Apparatus in accordance with claim 6 wherein the first relay switch element and the second relay switch element are normally closed and normally open respectively.

* * * * *